US006978529B1

(12) United States Patent
Pearse

(10) Patent No.: US 6,978,529 B1
(45) Date of Patent: Dec. 27, 2005

(54) PREPARATION AT A JOBSITE TO REPLACE A KITCHEN COUNTERTOP

(76) Inventor: Karen Pearse, 9 Truxton Ave., Dix Hills, NY (US) 11746

( * ) Notice: Subject to any disclaimer, the term of this patent is extended or adjusted under 35 U.S.C. 154(b) by 221 days.

(21) Appl. No.: 10/670,542

(22) Filed: Sep. 26, 2003

(51) Int. Cl.[7] ..... B23P 6/00
(52) U.S. Cl. ..... 29/402.08; 29/557
(58) Field of Search ..... 29/557, 558, 402.08

(56) References Cited

U.S. PATENT DOCUMENTS 2,365,940 A * 12/1944 Couse ..... 296/24.32
4,055,206 A * 10/1977 Griffin ..... 144/285
4,643,476 A * 2/1987 Montgerard ..... 296/24.32
6,286,577 B1 9/2001 Douglas et al.
6,325,435 B1 * 12/2001 Dubuc ..... 296/24.32

* cited by examiner

*Primary Examiner*—David P. Bryant
(74) *Attorney, Agent, or Firm*—Myron Amer P.C.

(57) ABSTRACT

Making accessible for replacement of a marble or like material constituted kitchen countertop at a jobsite, the transit in a truck of a construction material-cutting saw and a slightly oversized slab of the construction material to the jobsite, at which use is made of the removed kitchen countertop as a template on the slab as a cutting guide for the saw.

1 Claim, 2 Drawing Sheets

PREPARATION AT A JOBSITE TO REPLACE A KITCHEN COUNTERTOP

The present invention relates generally to improvements in replacing kitchen countertops, the improvements more particularly contributing to both more readily making the replacement and also achieving more accurate shape and dimension accuracy between the kitchen countertop being replaced and that installed in its place.

EXAMPLE OF THE PRIOR ART

According to present practice, the replacement of a kitchen countertop contemplates a workman coming to a person's house, measuring the old kitchen countertop, going back to the factory and preparing a replacement kitchen countertop, and then coming back to the person's house to complete the replacement. At the factory, and as described and illustrated in U.S. Pat. No. 6,286,577 for "PROCESS FOR FABRICATING COUNTERTOPS" issued to Douglas et al. on Sep. 11, 2001, a replacement countertop is prepared, using the measurements provide by the workman. Although perhaps not occurring often, but occurring often enough, the provided measurements are not accurately adhered to in the preparation of the replacement kitchen countertop, or the measurements were not properly taken in the first instance; the latter possibility might result from a shape of the old countertop which includes a position fitting into a 90 degree corner behind a sink, and thus not a routine chore.

Broadly, it is an object of the present invention to overcome the foreing and other shortcomings of the prior art.

More particularly, it is an object to obviate as unnecessary the duplicate trips between the factory and the jobsite of the replacement, i.e., the person's house, the tedium of measuring the old kitchen countertop, and avoiding lapses as noted in the current practice, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
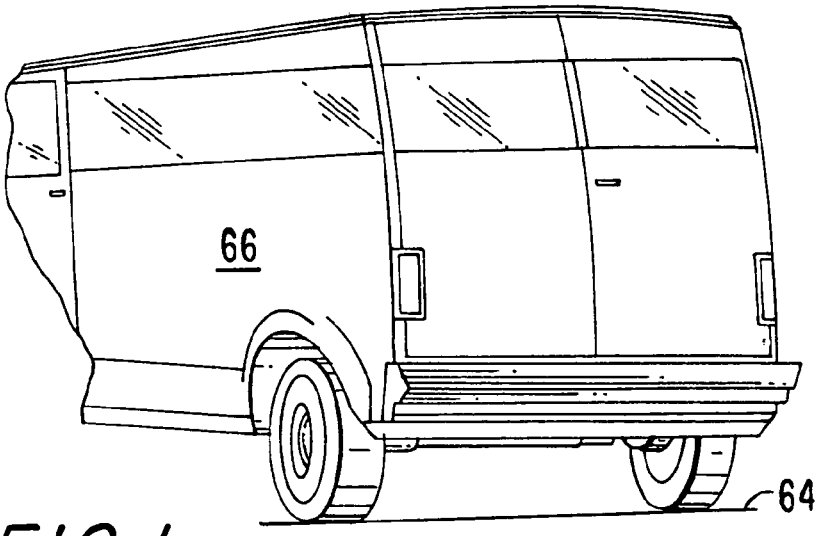
FIG. 1 is a partial perspective view of a vehicle at a jobsite with materials and apparatus for practicing the invention.
Figure 2:
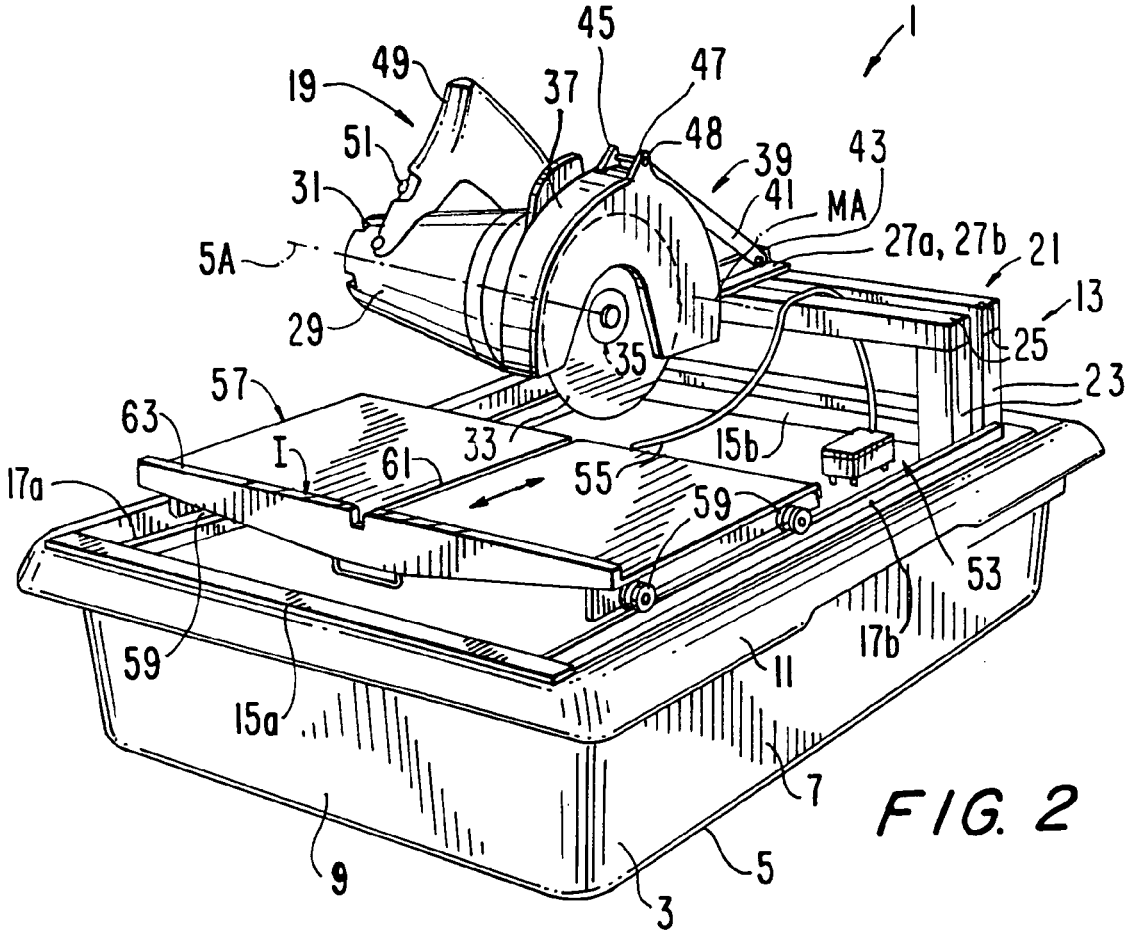
FIG. 2 is a stone-cutting saw that was in transit to the jobsite on the vehicle of FIG. 1.

Referring now to the drawings, and particularly to FIG. 2, a portable, direct drive abrasive or diamond saw intended to be used in the practice of the present invention is generally indicated by reference character 1. This abrasive saw is particularly well suited for a craftsman to cut marble, stone, composite stone, and like material in popular use for kitchen countertops.

Specifically, the saw is shown to include a base pan, as generally indicated at 3, preferable of a suitable electrically insulative, high strength, wear resistant synthetic resin material, such as a high density polyethylene or other high strength impact resistant plastic. The base pan includes a bottom wall 5, opposite sidewalls 7 and end walls 9. A rolled over lip 11 extends around the upper edges of the side and end walls thus providing a convenient fingerhold for carrying the base pan. It will be understood that the base pan thus constitutes a reservoir for holding a quantity of coolant (e.g., water) which, as will be hereinafater explained in detail, is circulated over the abrasive saw blade for cooling the saw blade and the work while the work is cut by the saw.

For example, base pan 3 may have an overall length of approximately 25½ inches, a width of approximately 18¾ inches and a depth of approximately 6 inches. Under normal operating conditions, the coolant reservoir will normally be filled with approximately 7 gallons of water.

A frame, as generally indicated at 13, is mounted within base pan 3 and is secured thereto. The frame includes a pair of opposite end members 15*a*, 15*b* formed of angle iron or the like disposed with the upper flange of the angle irons extending outwardly away from one another and with the other legs of the angles extending downwardly and adapted to be positioned on the inside of end walls 9. The underface of the upper flanges of these end members bear on the upper edge of lip 11 and thus support the frame within the base pan. Suitable fastener means, such as bolts or screws (not shown), may be inserted through the upper flanges of end members 15*a*, 15*b* thereby to secure frame 13 to the base pan.

Frame 13 is shown to further comprise a pair of rails 17*a*, 17*b* spaced apart from one another and extending longitudinally the length of base pan 3 between opposite end members 15*a*, 15*b*. Again, rails 17*a*, 17*b* are shown to be of angle iron construction oriented with one flange extending vertically and with a horizontal flange extending outwardly toward the inside faces of adjacent sidewalls 7. The upper edges of the vertical flange of these rail members constitute track or rail surface for purposes as will appear.

Further, saw 1 includes a unitary, direct drive, rotary saw assembly, as generally indicated at 19, fixedly positioned by frame 13. The frame includes a saw support, as generally indicated at 21, at the end of the frame adjacent end member 15*b*. Saw support 21 is shown to comprise a pair of vertical supports 23 spaced apart from one another and at each side of the frame secured (e.g., welded) to respective rail members 17*a*, 17*b* and extending vertically above the upper edge of the vertical flange of the rail members. Horizontal support members 25 extend transversely of the frame from the upper end of one vertical support member 23 to the upper end of a corresponding vertical support member of the opposite side of the frame. Again, vertical members 23 and horizontal members 25 are of angle iron construction and the horizontal transverse members 25 are oriented so as to have their upper flanges in generally horizontal position and vertical flanges extending downwardly with the horizontal upper flanges constituting a generally planar mounting surface.

A pair of cantilever arms 27*a*, 27*b* is mounted on the upper face of horizontal arms 25 so as to extend in cantilever fashion generally horizontally inwardly of the frame from the saw support 21 out over the center portion of the frame above base wall 5 of base pan 3. These cantilever arms 27*a*, 27*b* are shown to be a pair of spaced apart angle iron members secured to the horizontal members 25 in back-to-back relation.

The unitary direct drive saw assembly 19 is shown preferable to comprise a lightweight saw assembly, such as a hand-held circular power saw, including a housing 29. An induction electric motor, as indicated at 31, is mounted within housing 29 so as to directly drive an abrasive saw blade 33 about a saw axis, as indicted at SA in FIG. 2, for cutting a work piece. As is conventional with saw unit such as 19, a suitable direct drive gear train (not shown) is interposed between the rotor shaft (also not shown) of motor 31 and the drive shaft for saw blade 33.

As indicated at 35, a removable saw blade mounting arbor and locking bolt assembly is provided for readily permitting the removal of one saw blade and the installation of another on the drive shaft of the saw.

Saw 19 is provided with a saw blade guard 37 at least partially enclosing the saw blade and protecting users of the saw from inadvertently touching the rotating saw blade 33 while in operation. Saw 19 is pivotally mounted on cantilever arms 27 by means of a mounting bolt inserted through a boss provided on the housing 31 of the saw and extending through corresponding holes in the cantilever saw support arms 27*a*, 27*b*. In this manner, the saw 19 is rotatable about a mounting axis MA extending longitudinally through the center of the bolt whereby the saw axis SA extending through the rotary axis of saw blade 13 pivots relative to axis MA and thus is eccentrically mounted with respect to frame 13 for permitting vertical adjustment of the saw blade relative to the frame and the table.

Further, saw 17 is held in a desired adjusted position or height by means of a locking arrangement, as generally indicated at 39, including a strap 41 pivotally secured at its outer end to cantilever arms 27 by a pivot bolt 43. The strap 41 extends rearwardly and has an elongate slot 45 in its rear end portion. A bolt 47 is inserted through a hole in a boss 48 on the upper surface of guard 3. Bolt 47 is received in the elongate slot 45 and, upon tightening bolt 47, the guard assembly 37 and hence the saw assembly 19 is clampingly held in fixed position relative to bar 41 thus locking the saw assembly in a desired vertical position relative to the frame.

Saw assembly 19 is suitably modified to electrically ground all parts of the saw (e.g., the motor, the guard 37, and other metal components) so as to reduce the potential of electrical shock hazard to the user. Saw housing 29 further includes a handle 49 and an on/off toggle switch 51 is provided on the handle in a convenient location for operation by the user to energize and de-energize motor 31 and pump 53 at the same time.

An electrically operable, submersible pump, as generally indicated at 53, is located within base pan 3 for circulating coolant within the base pan to the rotating saw blade via coolant lines 55 leading from the pump to outlet nozzles on saw blade guard 37.

Further a work support table 57 is rollingly mounted on rail members 17*a*, 17*b* for translation in horizontal direction between a retracted position (as shown in solid lines in FIG. 2) in which the work supported on the upper face of table 57 and the table is clear of the cutting surfaces of saw blade 33 and a cutting position in which the saw blade cuttingly engages the work. The table is movable to its full cutting position such that the saw blade 33 may fully cut through work supported on the table. Table 57 is rollingly supported on the upper edges of the vertically extending flanges of rail members 17*a*, 17*b* by means of four steel rollers 59. A center groove 61 is provided in the work table extending down below the work supporting upper surface of the table for accommodating the lower periphery of saw blade 33 as the work table is moved from its retracted position to its full cutting position and as the saw blade cuts through the work supported on the table. A rear flange 63 is provided at the rear of the table with the flange extending above the height of the work supporting surface whereby the work to be cut may be properly aligned and held square with respect to the table so as to insure a true and square cut by saw blade 33 as the work support table is manually moved from its retracted to its cutting position.

The use contemplated for the saw 1 of FIG. 2 is to provide a replacement kitchen countertop for the countertop that is to be removed from the kitchen in a dwelling which it will be understood is at the jobsite, generally designated 64, within walking distance of the parked truck 66 having within its interior the saw 1. To best understand how the kitchen countertop, generally designated 68, is disassembled preparatory to removal of the countertop 68 that is to be replaced, it is helpful to know how it is assembled, and to this end reference should be made to FIG. 3.

Figure 3:
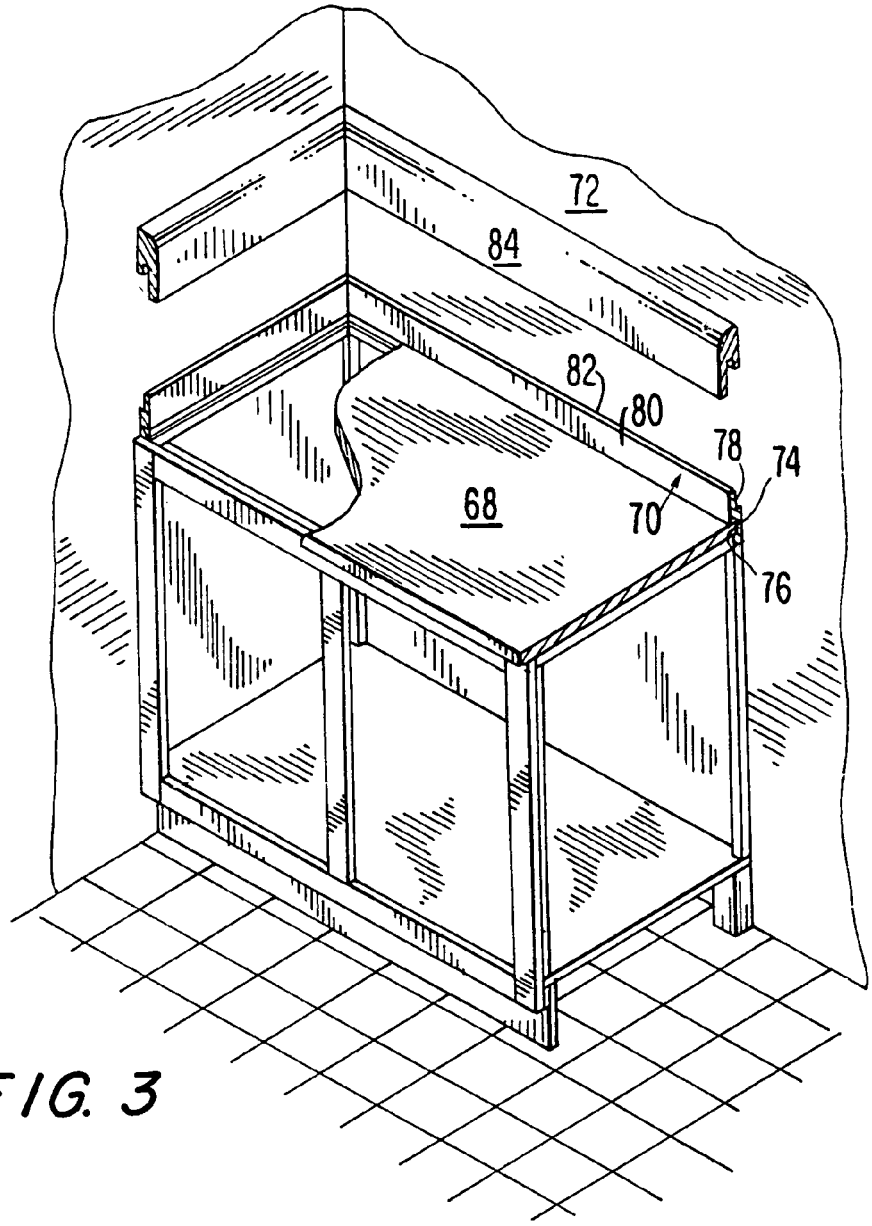
FIG. 3 is a perspective view, partially in section, of a kitchen countertop at the jobsite.

As may be seen in FIG. 3, the construction material of countertop 68 is typically marble, stone composition, or the like, because of its durability and appearance. Retainer strip 70 has a flat rear face and is fastened to a wall 72. A square groove 74 is cut or formed in a front face of the elongated retainer strip 70 and accepts the rear edge 76 of countertop 68. An upwardly extending tongue 78 is formed along the top of the retainer strip 70 and is spaced outwardly from wall 72. Tongue 78 has a flat front surface 80 and a beveled rear portion 82. A workman familiar with the construction as just described, merely reverses the assembly and removes the rear edge 76 of countertop 68 from the retainer strip 70, which itself is readily disassembled once the backsplash 84 is lifted off the retainer strip.

Figure 4:
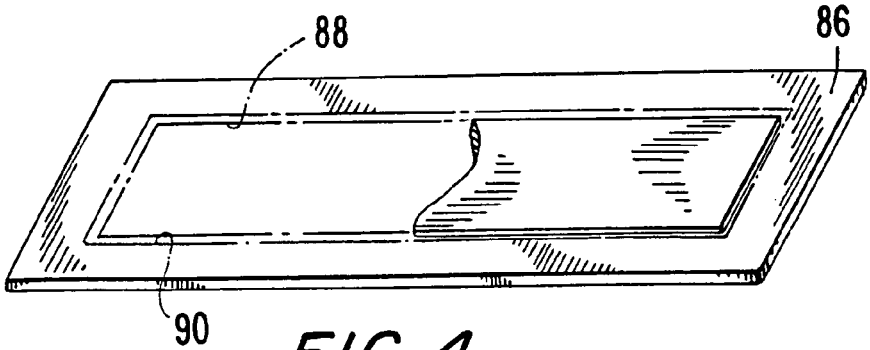
FIG. 4 illustrates the practicing of the within inventive method.

The countertop 68 is then carried bodily out of the kitchen and to the vehicle or truck. It is placed on the replacement slab 86, of marble or composite stone, as the case may be, and used as a template, and as best understood from FIG. 4, a cutting guideline 88 is drawn, either manually or by pantograph, or edge-sensing means, such as by a commercially available electronic templating device sold under the designation "Proliner," by Innovative Marble & Tile, Inc. of Hauppauge, N.Y. 11788.

The replacement slab 86 with the applied cutting guideline 88 is then cut to size and shape by the cutting saw 1, and the resulting replacement kitchen countertop 90 carried back into the kitchen of FIG. 3 and assembled in place.

What has been described thus eliminates the need of a workman coming to the person's house measuring the old kitchen countertop, going back to the factory and preparing a replacement kitchen countertop, and then coming back to the person's house to complete the replacement.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method for a factory to replace a jobsite article of manufacture comprising the steps of:

A. designating for replacement a marble kitchen countertop of a known size constituted by a peripheral edge thereabout in a known dwelling constituting said jobsite;

B. transporting to said jobsite in a truck (1) a marble-cutting saw having (a) a marble cutting means; and (b) a marble-support means in cutting relation to said marble cutting means; and (2) a slab of marble from a factory characterized in having confines exceeding said known size of said kitchen countertop in supported relation upon said marble-support means;

C. removing said kitchen countertop designated for replacement from its location in said dwelling;

D. positioning said thusly removed kitchen countertop in superposed relation upon and within said confines of said marble slab so as to present for demarcation a peripheral edge oversize of the slab relative to said kitchen countertop;

E. demarcating, by using as a template said positioned kitchen countertop, a cutting guideline in parallel relation to said kitchen countertop peripheral edge on said marble slab;

F. cutting, by using said marble-cutting saw, along said cutting guideline; and

G. replacing at said location vacated by said kitchen countertop in said dwelling said thusly cut marble slab;

whereby there results in said marble slab at said jobsite an article of manufacture serving as a replacement for said kitchen countertop removed from said dwelling.

* * * * *